United States Patent [19]

Moulton

[11] Patent Number: 4,527,298

[45] Date of Patent: Jul. 9, 1985

[54] ELECTRO PNEUMATIC BED

[76] Inventor: Lee A. Moulton, 5081 Keane Dr., Carmichael, Calif. 95825

[21] Appl. No.: 359,617

[22] Filed: Mar. 18, 1982

[51] Int. Cl.[3] ..... A61G 7/06

[52] U.S. Cl. ..... 5/66; 5/453; 5/455; 5/507

[58] Field of Search ..... 5/66–69, 5/507, 508, 953–956; 248/441.1; 108/42, 49, 59, 111; 137/58, 137 R

[56] References Cited

U.S. PATENT DOCUMENTS

| | | | |
|---|---|---|---|
| 548,857 | 10/1895 | Wales | 5/411 |
| 1,189,781 | 7/1916 | Beylard | 116/137 R |
| 1,559,119 | 10/1925 | Miller | 5/411 |
| 2,769,182 | 11/1956 | Nunlist | 5/68 |
| 3,392,723 | 7/1968 | Calvin | 5/60 |
| 3,456,209 | 7/1969 | Goodman | 5/66 |
| 3,644,946 | 2/1972 | Swatt | 5/68 |
| 3,667,075 | 6/1972 | Ballard | 5/67 |
| 3,935,604 | 2/1976 | Collins | 5/465 |
| 4,287,620 | 9/1981 | Zur | 5/68 |
| 4,309,783 | 1/1982 | Cammack | 5/66 |

FOREIGN PATENT DOCUMENTS 2070426 9/1981 United Kingdom .

*Primary Examiner*—Gary L. Smith
*Assistant Examiner*—Michael F. Trettel
*Attorney, Agent, or Firm*—Leonard Bloom

[57] ABSTRACT

A pneumatically adjustable bed in which a series of air bladders are strategically placed to adjust the posture of the mattress on a bed so that the occupant of the bed can adjust his posture without having to move. A centrally disposed pneumatic manifold with a motor and a blower is employed to inflate and deflate the various bladders separately, thus posture can be very precisely controlled.

14 Claims, 12 Drawing Figures

FIG 8
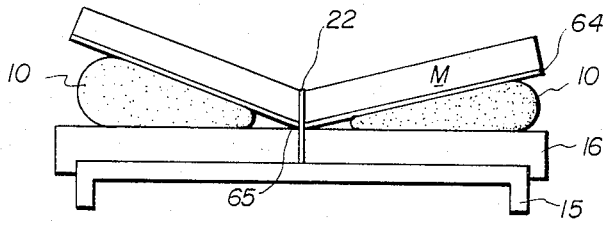
FIG 9
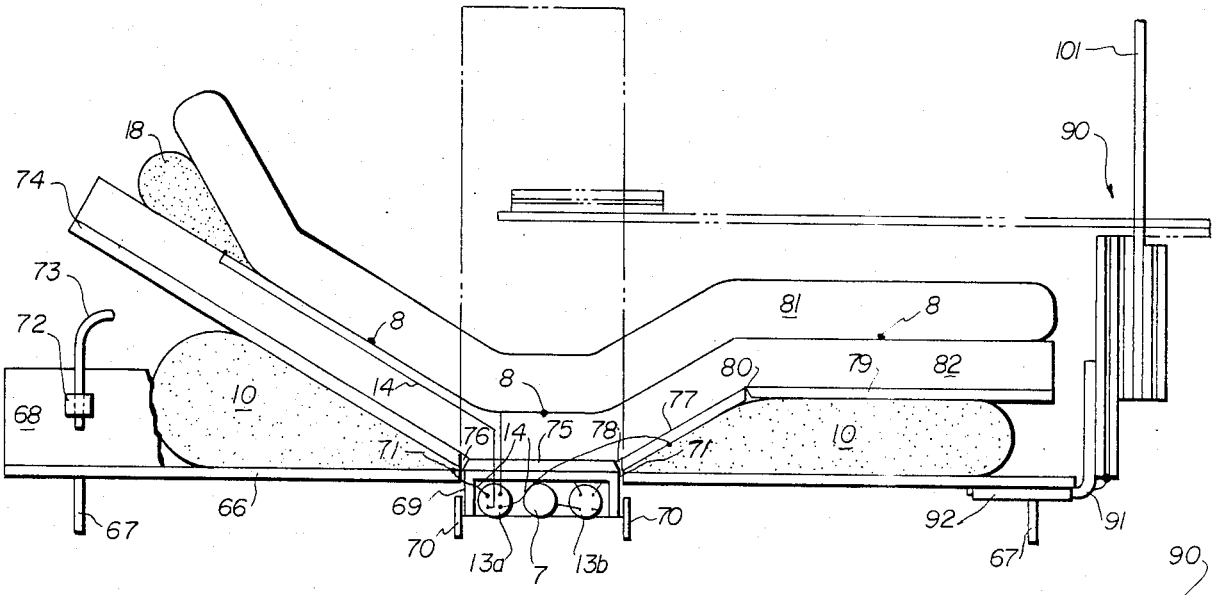
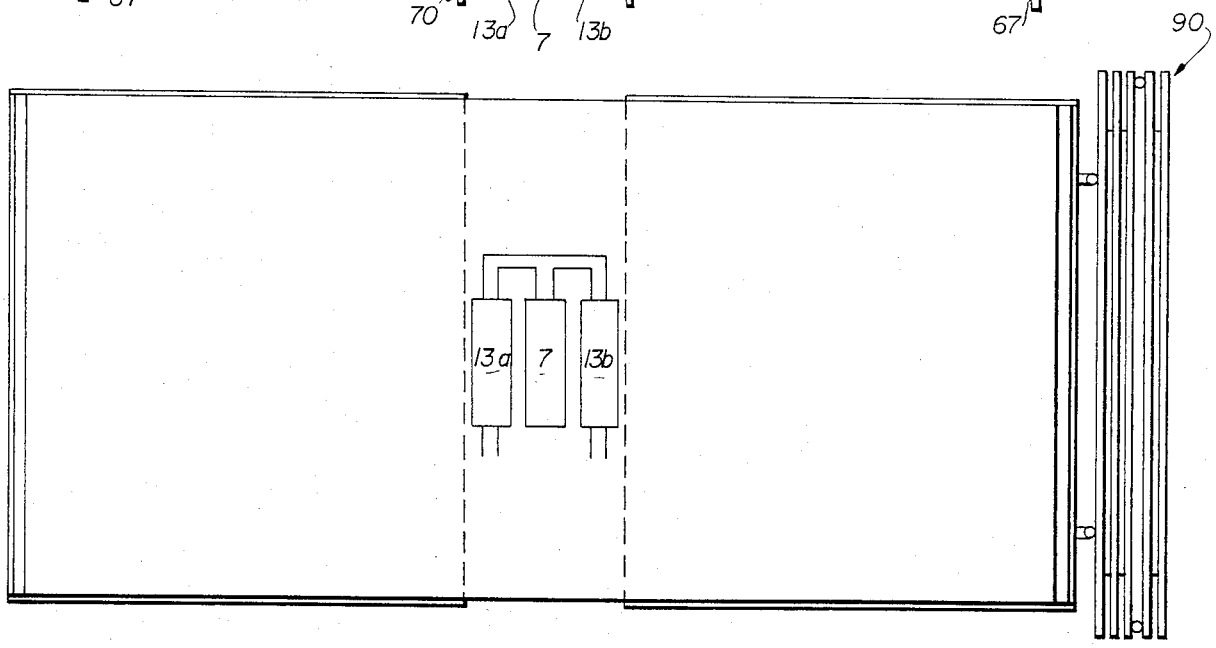
FIG 10

FIG 11
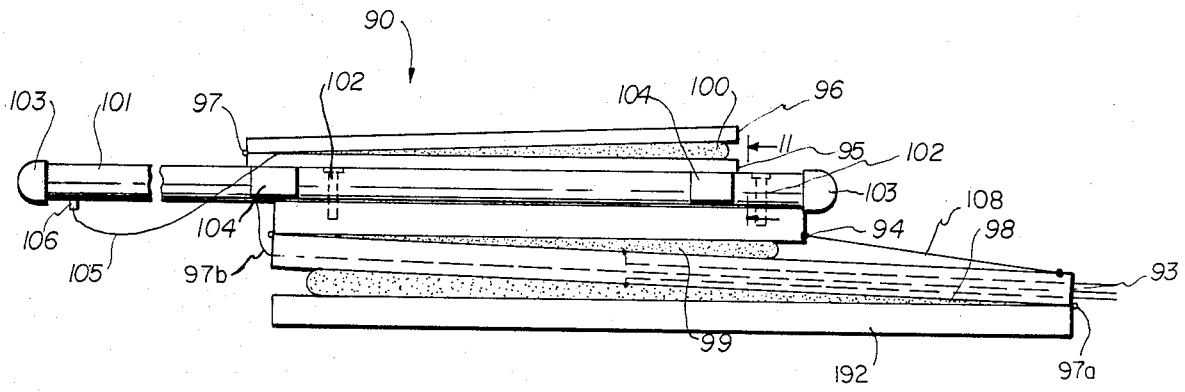
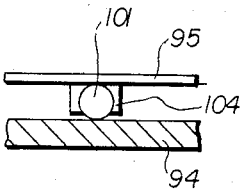
FIG 12

ELECTRO PNEUMATIC BED

BACKGROUND OF THE INVENTION

The present invention relates generally to adjustable beds and more specifically to an adjustable bed with pneumatic pillows to vary the contours of the surface of the bed.

For individual patients in a hospital or residents in a nursing home, especially those who are non-ambulatory, it is often necessary and therapeutic to provide a bed which can be adjusted by the patient to a variety of positions by simply pushing a series of buttons which avoids any unnecessary strain on the patient, and provides the freedom of selection of posture. For example, a patient returning from surgery may be required to avoid any strain until a certain healing process has progressed sufficiently to allow ambulation. However, the patient may want to change posture to read or eat or the like and the device according to the instant application allows effortless and intricate posture adjustments.

The broad concept of an adjustable bed to change the posture of the occupant is well known in the prior art. Prior art devices range from a bed provided with a mechanical crank at the foot to be adjusted by a person other than the occupant to pneumatic and electromechanical devices which control posture from controls operated by the occupant. The following patents reflect the state of the art of which applicant is aware insofar as they appear germane to the patent process: U.S. Pat. Nos. 3,606,623, Aymar; 3,879,772, Pol; 3,781,928, Swallert; 4,142,263, Pierson.

Of the references cited the patent to Swallert would appear to be of primary interest since he teaches the use of a device for raising the head and/or foot end of a bed in which an inflatable pad is positioned beneath a mattress at the opposed ends of a bed and a compressor is provided to inflate the pads so as to raise and lower the mattress.

Pierson teaches the use of a similar device for insertion under the mattress near the head end enabling adaptability of use and simplicity of operartion.

The remaining references show the state of the art further.

However, none of the references developed appears to teach or render obvious the device according to the instant application which provides a plurality of pneumatic bladders placed both below and above the mattress to afford a full range of posture adjustment for the occupant of the bed. Furthermore, all the bladders are operatively connected to a single pneumatic blower which permits coordinated inflation and deflation, thereby permitting subtle adjustments of posture.

SUMMARY AND OBJECTS OF THE INVENTION

Accordingly, it is a primary object of the present invention to provide a novel apparatus for adjustment of bed posture which can be used in conjunction with various sizes of standard or water beds and can be retrofitted to existing mattresses.

It is another object of the present invention to provide a novel apparatus for adjustment of bed posture which allows independent adjustment of firmness and elevation at the head, center or foot of the bed and further allows adjustment of a top pillow placed at either the head or foot of the bed.

It is a further object of the present invention to provide a novel apparatus for the adjustment of bed posture which can assist in the positioning of the body to allow accurate, unencumbered X-rays to be taken of non-ambulatory patients.

It is still another object of the present invention to provide a novel apparatus for the adjustment of bed posture which is durable, safe to use, and supplies a source of pneumatic pressure for accessories.

These and other objects are accomplished by the provisions of a series of pneumatic bladders strategically placed above and below a mattress and interconnected and coordinated by a central pneumatic blower unit so that adjustment of air pressure in the various bladders adjusts the posture assumed by the bed.

The objects stated above and other objects will become apparent when taken in conjunction with the appended drawing figures.

BRIEF DESCRIPTION OF THE DRAWING FIGURES

FIG. 8 is a side view of a two bladder embodiment of the invention.

FIG. 9 is a side view of an entire bed constructed according to the instant invention. The figure in phantom represents the folded up storage position for the bed.

FIG. 10 is a top view of the bed.

FIG. 11 is an end view of the retractable bed table.

FIG. 12 is a sectional end view taken along lines 11—11 of FIG. 11.

DESCRIPTION OF THE PREFERRED EMBODIMENT

Figure 1:
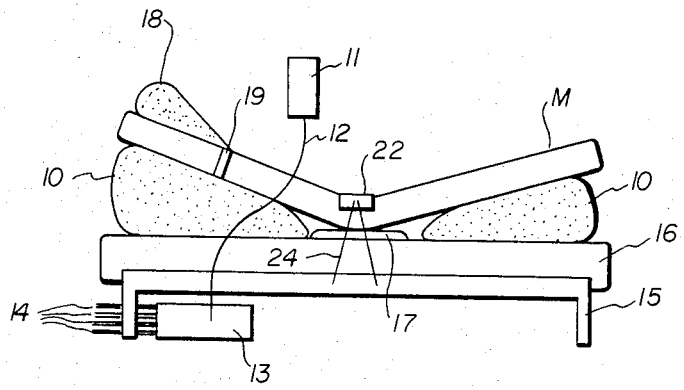
FIG. 1 is a side view of a bed with the instant apparatus installed and inflated.

Referring now to the drawings in detail wherein like reference numerals represent like parts throughout the several figures reference numeral 10 refers generally to a large air bladder placed beneath the mattress M.

A control unit 11 is connected by a cable 12 to a central pneumatic unit 13 which supplies compressed air to the air bladders 10 by a series of pneumatic lines 14. A bed frame 15 supports a box spring 16 or the like upon which the air bladders 10 are supported. A smaller centrally disposed air bladder 17 is provided between the two bladders 10 to permit central mattress adjustment and connect the other bladders 10 thereby preventing them from migrating. A head pillow bladder 18 is provided on an upper surface of the mattress M to afford further adjustment of bed posture. The head bladder 18 is positioned by a strap 19. In this embodiment, the invention is deployed or retrofitted to an existing bed.

Figure 2:
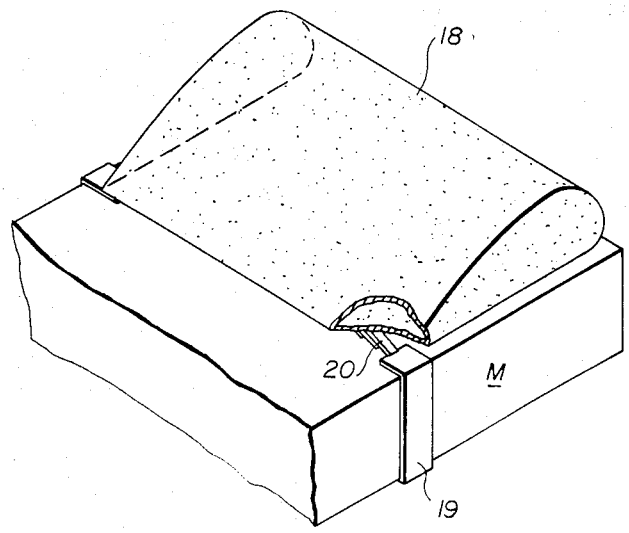
FIG. 2 is a perspective view of the inflatable head pillow installed above a surface of the mattress.
Figure 4:
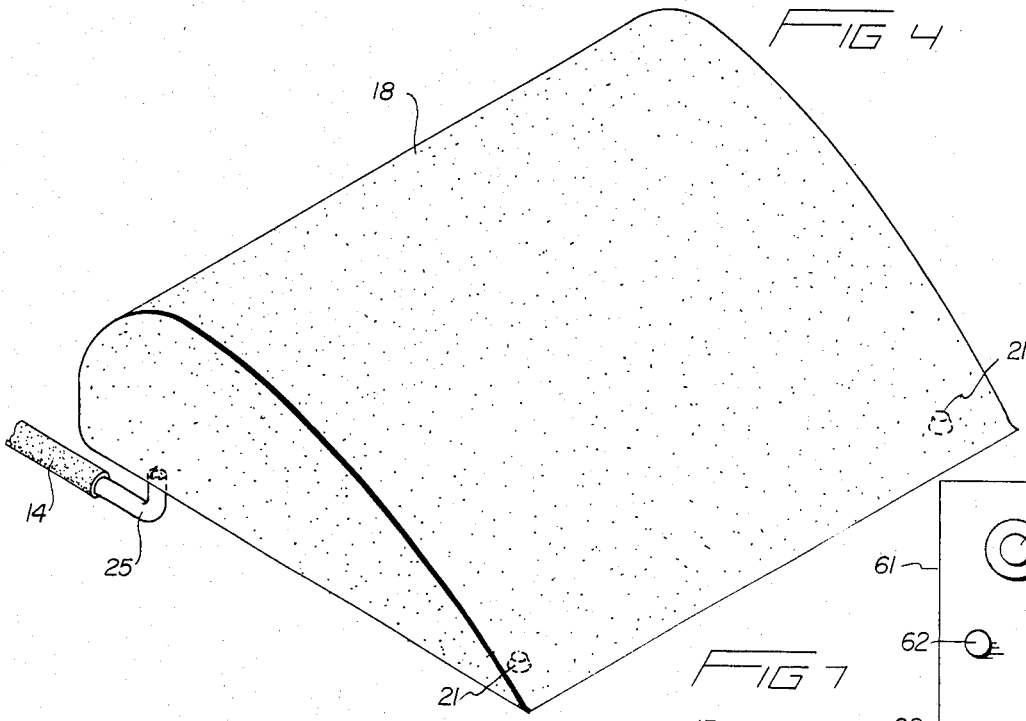
FIG. 4 is a perspective view of an air bladder showing an inlet hose and tie down buttons which firmly locate and position an air bladder.

FIG. 2 shows the deployment of the head bladder 18 which is positioned by means of the tie down strap 19 which has a buckle 20 to engage a button 21 like that of FIG. 4, thereby firmly positioning the head bladder 18.

Figure 3:
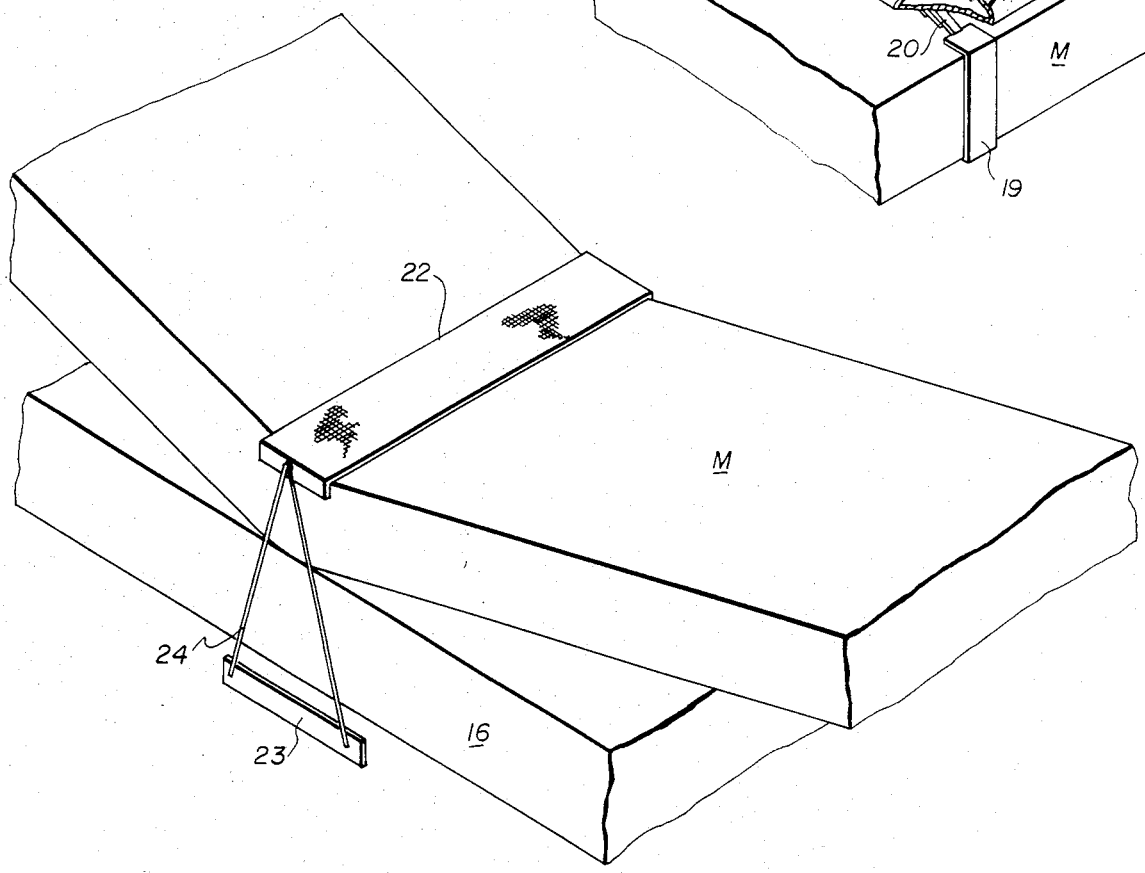
FIG. 3 is a perspective view of a mattress depicting a central mattress tie down.

A central positioning strap 22 (FIG. 3) firmly engages the mattress M and prevents it from migrating when various bladders are being inflated or deflated. The central positioning strap 22, which is constructed from a soft material such as cloth, engages a bed frame 15 by means of a plate 23 which is connected to the strap 22 by a flexible cord 24 so that pressure is maintained on the central strap 22 and mattresses of various thickness can be easily accommodated.

FIG. 4 shows a large bladder 18 with a pneumatic line 14 feeding into an L-shaped nipple 25 which affords a means of ingress and egress for the air. Positioning buttons 21 appear on a bottom face of the bladder 18 to provide a purchase upon which the positioning strap 19 can engage and locate the bladder 18 so that it will not migrate during inflation use and deflation relative to the mattress.

Figure 5:
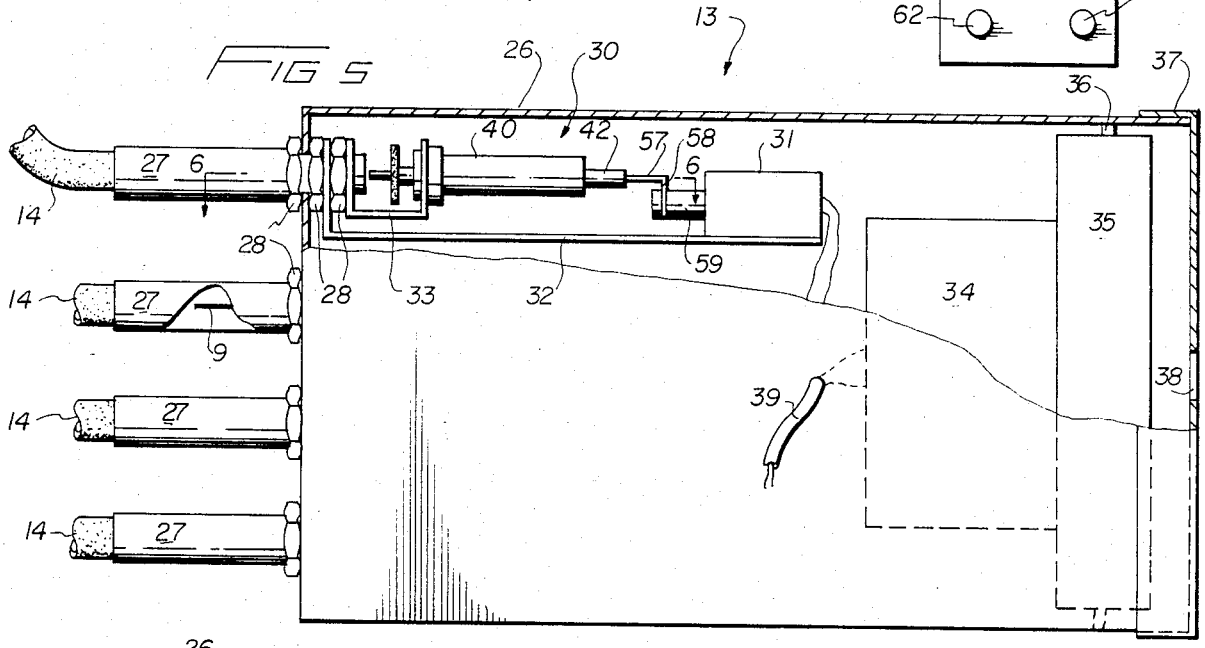
FIG. 5 is a top cutaway view of a central pneumatic unit showing the pneumatic valves and the solenoids which actuates them.

The central pneumatic unit 13 (FIG. 5) has an air tight body 26 with a series of four threaded nipples 27, appearing through a side wall thereof, which receive four pneumatic lines 14. The nipples 27 are provided on their interiors with a read 9 which makes noise when air passes through the nipples 27 to indicate inflation. The threaded nipples 27 are located and sealed into the main body manifold 26 by means of a series of thin flat nuts 28. Located inside the main body 26 of the central pneumatic unit 13 are a plurality of two-position pneumatic valves, generally referred to by reference numeral 30, and a matching plurality of solenoids 31 which in conjunction control the ingress and egress of air into the plurality of pneumatic lines 14. The solenoid 31 is mounted on an elongate L-shaped bracket 32 which is affixed to the nipple 27 by the flat nuts 28. Similarly, the pneumatic valve 30 is mounted to the nipple 27 by means of a U-shaped bracket 33. Also contained within the main body 26 of the central pneumatic unit 13 is an electric motor 34 which powers a two-stage blower 35 that is the source of the air to inflate the air bladders. The blower 35 and the motor 34 are supported in the main body 26 by nonforaminous support web members 36 which locate the blower and position it so that air is directed toward the various pneumatic valves 30 thereby providing a main body plenum. The main body 26 has an open end adjacent to the blower which is covered by a cover plate 37 which has an aperture 38 that allows air to be drawn into the main body and through the blower 35. An electrical cable 39 provides power to the motor 34 and the series of solenoids 31.

Figure 6:
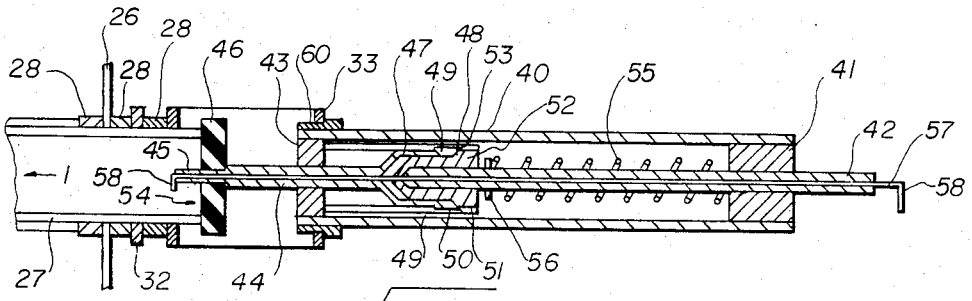
FIG. 6 is sectional view taken along lines 6—6 of FIG. 5.

FIG. 6 shows a cross-sectional view in greater detail of the two-position pneumatic valve, where a cylindrical main body 40 has an end plug 41 with an aperture to receive a first hollow cylindrical rod 42 and at the opposite end thereof a second plug 43 with an aperture to slidably receive a second hollow thrust rod 44. The thrust rod 44 has a stepped end 45 which receives a flap valve 46. The opposite end of the thrust rod 44 flares into an expanded cylinder 47 substantially the same diameter as the inner diameter of the cylindrical body 40. The rod cylinder 47 terminates in a crenelated lip 48 and it is also provided with a series of symmetrical, peripherally disposed longitudinally extending keyways 49 which mate with and are engaged by a series of linear slots or keyways 49 disposed on the inner face of the cylindrical body 40. Every other slot 49 has a stop 50 which will engage a bevelled key 51 provided on a separate cap member 52 which engages the inward end of the first hollow rod 42. The cap 52 is a slip-fit into the flared cylinder 47 so that the crenelations on the lip 48 can engage bevels 53 on the cap 52 thereby rotating the cap one notch at a time and alternately placing the keys 51 in a keyway 49 with a stop 50 and then in a keyway 49 without a stop. Thus, the thrust rod 44 and the flap valve 46 disposed thereon can be alternated and indexed between one of two positions. The first position where the flap valve 46 covers and seals an orifice 54 in the nipple 27, which occurs when the key 53 is disposed in a slot 49 without a stop 50. In the second position, the key 53 is disposed in a keyway 49 with a stop 50 and the flap valve 46 and thrust rod 44 associated therewith are held in a position remote from the orifice 54 and the nipple 27. A spring 55 is disposed around the first hollow rod 42 and rests on one end against the end plug 41 and on the other against a stop peg 56 in order to bias the first rod 42 towards the second rod 44. A long wire or shaft 57 extends longitudinally through the hollow sections of the rods 42 and 44 terminating at either end by an L-shaped crimp 58. The crimp 58 on the shaft 57 which extends from the rod 42 is used to engage the solenoid 31 by means of an actuation arm 59 extending from the solenoid 31.

The main body of the valve 40 proximate to the end plug 43 is provided with a collar 60 which is threaded into the mounting bracket 33.

Figure 7:
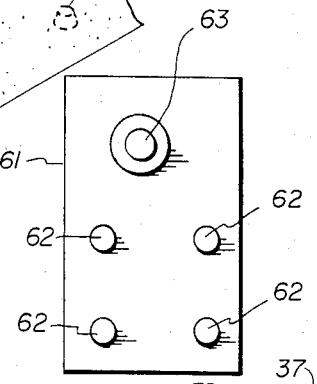
FIG. 7 is a top view of a control unit.

A control panel 61 FIG. 7, is connected to the central pneumatic unit 13 by means of a cable 12 and is provided with four buttons 62 each of which controls one of the four pneumatic valves 30. A knob 63 controls the blower 35. Thus, in operation an occupant would turn on the blower 35 and open one of the valves 30 by means of one of the buttons 62 so that air would flow into one of the four bladders, which would adjust the position of the bed. It should also be noted that the control panel 61 may also be provided with a means to control any other accessories such as vibrators or extra bladders.

FIG. 8 depicts a further preferred embodiment of the invention in which the air bladders 10 are placed between the box spring 16 and a foundation board 64 which directly underlies the mattress M. The foundation board 64 is provided with a flexible central area 65 so that it may bend in that zone 65. This embodiment also employs a central tie down strap 22 to positively locate the mattress M in relation to the bed. It is contemplated that this embodiment would chiefly be employed to retrofit the invention to existing beds.

A further preferred embodiment is shown in FIG. 9 in which the entire bed and all its components are provided. A bed frame 66 is provided with legs 67 and a rectangular containment border 68 which defines the perimeter of the bed. The frame 66 is provided in a central area on an underside thereof with a further support structure 69 which defines an area that contains two central pneumatic units 13(*a*) and 13(*b*) to provide pressurized air for various functions. The support structure 69 is also provided with wheels 70 so that when the entire bed is folded up, as shown in phantom, it can be rolled to a new position or stored. The frame 66 is hinged where it joins the support structure 69 as indicated by reference numeral 71. This permits the front and rear section of the bed to be folded upwardly in the storage or portable position.

The containment border 68 is provided with brackets 72 to support a handrail 73. A four piece bedboard has a first segment 74 which underlies the head area of the bed and provides the surface against which the first bladder 10 inflates to raise the head area of the bed. A second segment 75 of the bedboard is a short centrally located segment which underlies the central portion of the bed and it is hinged to the first segment 74 at the hinge area 76. A third segment 77 is similarly hinged to the second segment 75 at hinge 78. The third segment 77 is substantially the same length as the second segment 75 and is designed to underlie the thigh area. A fourth segment 79 is hinged to the third segment 77 at hinge area 80. The fourth segment is designed to underlie the leg area. The third segment 77 and the fourth segment 79 provide the surfaces against which the air bladder 10 can inflate.

The configuration of the bedboard determines the configuration of an inflatable mattress 81 and is designed to substantially emulate a desirable posture for the human body. A foundation pad 82 is provided on an upper surface of the bedboard and runs coextensive with the bedboard. The inflatable air mattress 81 directly overlies the foundation pad 82 and provides the surface upon which the occupant rests. The mattress 81 is connected to the foundation pad 82 by a series of snaps 8. A pillow bladder 18 is provided between the air mattress 81 and the foundation pad 82 at the head area and is designed to raise the head of the occupant when inflated.

A first valve plenum unit 13*a* is provided with four pneumatic lines 14 each of which provides air to the pneumatic components which consist of the two bladders 10 the head bladder 18 and the mattress 81. A second valve plenum unit 13*b* is provided to pressurize any accessories such as a retractable bed table unit generally referred to by reference numeral 90. Both valve plenums are supplied by a single central blower 7.

The retractable bed table 90 is supported by an L-shaped support member 91 that fits into a tube 92 connected to the bed on the underside of the bed frame 66 proximate to the leg 67.

Referring now to FIG. 11, the "pneumatic service unit" 90 consists of three primary leaves 192, 93 and 94 and two secondary leaves 95 and 96 working with bed posts 101 and associated elements as indicated. The purpose and function of this service unit is to serve the needs of an individual while in bed including needs such as: (1) a tray for eating or writing: (2) a monkey bar for assistance in getting into or out of bed; and (3) various pulling, lifting, or holding needs which may be required to serve a sick, weak or injured person. The first leaf 192 is mounted to the support member 91 so that the spring loaded hinge 97*a* is at the base joining leaves 192 and 93 and spring loaded hinge 97*b* is at the top joining leaves 93 and 94. Air bladder 98 is disposed between leaves 192 and 93; bladder 99 is disposed between leaves 93 and 94; and bladder 100 is disposed between leaves 95 and 96. The service table 90 made up of leaves 95 and 96 along with associated bladder 100 are slidably disposed upon the pneumatic bed posts 101 by horseshoe clip 104 as shown in FIG. 12.

In its reefed or stored position the service table 90 appears as shown in FIG. 9. In its deployed position the service table appears as shown in FIG. 9 in phantom. To accomplish deployment air is transmitted first from central pneumatic unit 13*b* to bladder 99 which causes leaf 94 to rotate in an upward direction which in turn causes the bed posts 101 to rotate downwardly until restrained by chain 108. The maximum rotation is preset by adjustment of chain 108 which would normally allow posts to rotate 90 degrees to a horizontal position. This position now allows the service table 90 to slide forward and be locked to a desired position and the attachment of pneumatic line 105 between the bed post nipple 106 and service table bladder 100. Inflation of bladder 98 will now cause leaf 93 to rotate in a rear downwardly direction causing the bed posts 101 and service table to be lifted. This permits the adjustment of the service table to any desired height and use of attachments to the service table for numerous functions such as getting in or out of bed. The slope of service table leaf 96 can be adjusted by the inflation of bladder 100 about hinge 97. The reversal of the above process is assisted by spring loaded hinges 97, 97*a* and 97*b* which cause the leaves to return to the retracted position when the air is allowed to exit the bladders.

Having thus described the preferred embodiment of the invention, it should be understood that numerous structural modifications and adaptations may be resorted to without departing from the spirit of the invention.

What is claimed is:

1. A pneumatically adjustable bed comprising, in combination:

plural pneumatic air bladders disposed on surfaces of mattress means, a pneumatic unit with a remote control to inflate and deflate said bladders provided with connecting means to transmit air from said pneumatic unit to said bladders, actuating means on said remote control to activate said pneumatic unit, means for fastening said plural bladders such that in use and inflation said bladders do not migrate, and a hinged bed board placed underneath said mattress pad wherein said pneumatic unit comprises a blower with an electric motor mounted inside a manifold which selectively directs air through at least one two position pneumatic valve into said connecting means and thereafter to said bladders wherein said connecting means comprises pneumatic air lines with nipples wherein said nipples are provided with reeds to provide a noise when air passes therethrough wherein said remote control selectively actuates plural said pneumatic valves thereby controlling which bladders are inflated or deflated wherein said means for fastening comprises tethers and straps interconnecting plural said bladders and said mattress means wherein said valves comprise in combination a cylindrical body with end plugs with central apertures therein to receive a first hollow thrust rod, one end of which flares into a hollow cylinder with provided on an outer surface with peripherally disposed longitudinally extending keys which mate with linear keyways on an inner surface of said body and further provided on a forward edge with a crenellated lip with bevelled crenels which engage bevels on a cap of a second hollow rod biased towards said first rod by a spring whereby pressing said second rod inwardly rotates said flared cylinder on said first rod said keys alternately engaging a keyway with a stop and then a keyway without a stop so that a flap valve on said first rod alternates from a position covering an orifice to a remote position thereby allowing air to enter said orifice.

2. The device of claim 1 including a mattress supporting, foldable frame pivoting about two centrally disposed hinges thereby closing to a vertical storage position.

3. The device of claim 2 including a retractable bed table connected to said frame comprises a series of hinged leaves with table bladders disposed therebetween whereby filling said table bladders deploys said bed table.

4. The device of claim 3 wherein said bed board is placed underneath a foundation pad which underlies said mattress and is on top of some of said bladders, said bed board comprised of four segments serially hinged, one of said segments underlying a head area, and another said segment underlying a back area, another said segment underlying a thigh area, and a last said segment underlying a lower leg area whereby inflation of said bladders articulates the contours of said mattress according to the structural constraints provided by said segments of said bed board.

5. A bed adjustable in the presence of fluidic pressure comprising in combination:

a bed support, adjustable foundation means to lie above said bed support, including at least one bladder responsive to the presence of fluidic pressure, a mattress placed above said foundation means and tether means to fasten said bed support to said mattress at a mattress central area which is transverse to the longitudinal aspect of said mattress whereby expansion of said bladder causes controlled bending of said mattress about said tether means to obviate the tendency of said mattress to ride up and bridge about said central area, means to provide fluidic pressure to said bladder, a source of fluidic pressure, a conduit extending between said bladder and said source, valve means on said source to allow selective passage of fluid between said source and said bladder through said conduit, solenoid means remotely conditioned to cycle said valve means between a first valve sealed and second valve opended position, and said valve means including static retention means to hold said valve means in either position without any continued application of force to said valve means, whereby said solenoid means is momentarily energized for either position.

6. The device of claim 5 wherein said fluidic pressure means comprises a blower with an electric motor mounted inside a manifold which selectively directs air through at least one said valve and audible means are provided within said conduit to denote the passage of air therethrough.

7. The device of claim 6 including plural said bladders, conduits, and valve means all connected to a common said source of fluidic pressure; and respective sets of said conduits, said valves, and said bladders are independently connected for independent operation.

8. The device of claim 7 wherein said plural bladders are tethered to said mattress to prevent migration therefrom.

9. The device of claim 5 wherein said valve means comprises in combination a cylindrical body with end plugs with central apertures therein to receive a first hollow thrust rod, one end of which flares into a hollow cylinder provided on an outer surface with peripherally disposed longitudinally extending keys which mate with linear keyways on an inner surface of said body and further provided on a forward edge with a crennelated lip with bevelled cranels which engage bevels on a cap of a second hollow rod biased towards said first rod by a spring whereby pressing said second rod inwardly rotates said flared cylinder on said first rod, said keys alternately engaging a keyway with a stop and then a keyway without a stop so that a flap valve on said first rod alternates from a position covering an orifice to a remote position thereby allowing air to enter said orifice.

10. A bed adjustable in the presence of fluidic pressure comprising in combination:

a bed support, adjustable foundation means to lie above said bed support, including at least one bladder responsive to the presence of fluidic pressure, a mattress placed above said foundations means, a means to provide fluidic pressure to said bladder wherein said fluidic pressure means includes a source of fluidic pressure, a conduit extending between said bladder and said source, a valve means on said source to allow selective passage of fluid between said source and said bladder through said conduit, solenoid means remotely conditioned to cycle said valve means between a first valve sealed and second valve opened position, and said valve means including static retention means to hold said valve means in either position without any continued application of force to said valve means, whereby said solenoid means is momentarily energized for either position.

11. The device of claim 10 including tether means to fasten said bed support to said mattress at a mattress central area which is transverse to the longitudinal aspect of said mattress whereby expansion of said bladder causes controlled bending of said mattress about said tether means to obviate the tendency of said mattress to ride up and bridge about said central area.

12. The device of claim 11 wherein said fluidic pressure means comprises a blower with an electric motor mounted inside a manifold which selectively directs air through at least one said valve and audible means are provided within said conduit to denote the passage of air therethrough including plural said bladders, conduits, and valve means all connected to a common said source of fluidic pressure; and respective sets of said conduits, said valves, and said bladders are independently connected for independent operation wherein said plural bladders are tethered to said mattress to prevent migration therefrom.

13. The device of claim 12 wherein said plural bladders are tethered to said mattress to prevent migration therefrom.

14. The device of claim 10 wherein said valve means comprises in combination a cylindrical body with end plugs with central apertures therein to receive a first hollow thrust rod, one end of which flares into a hollow cylinder provided on an outer surface with peripherally disposed longitudinally extending keys which mate with linear keyways on an inner surface of said body and further provided on a forward edge with a crennelated lip with bevelled cranels which engage bevels on a cap of a second hollow rod biased towards said first rod by a spring whereby pressing said second rod inwardly rotates said flared cylinder on said first rod, said keys alternately engaging a keyway with a stop and then a keyway without a stop so that a flap valve on said first rod alternates from a position covering an orifice to a remote position thereby allowing air to enter said orifice.

* * * * *